US008587400B2

(12) United States Patent
Nakajima et al.

(10) Patent No.: US 8,587,400 B2
(45) Date of Patent: Nov. 19, 2013

(54) LAMINATED INDUCTOR, METHOD FOR MANUFACTURING THE LAMINATED INDUCTOR, AND LAMINATED CHOKE COIL

(75) Inventors: Takashi Nakajima, Takasaki (JP); Yoshiaki Kamiyama, Takasaki (JP); Kenji Okabe, Takasaki (JP); Yukihiro Noro, Takasaki (JP); Tomomi Kobayashi, Takasaki (JP); Yoshie Amamiya, Takasaki (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 193 days.

(21) Appl. No.: 13/055,911

(22) PCT Filed: Jul. 30, 2009

(86) PCT No.: PCT/JP2009/063901

§ 371 (c)(1),
(2), (4) Date: Jan. 25, 2011

(87) PCT Pub. No.: WO2010/013843

PCT Pub. Date: Feb. 4, 2010

(65) Prior Publication Data

US 2011/0133881 A1 Jun. 9, 2011

(30) Foreign Application Priority Data

Jul. 30, 2008 (JP) ..... 2008-195575

(51) Int. Cl.
*H01F 5/00* (2006.01)
*H01F 27/28* (2006.01)

(52) U.S. Cl.
USPC ..... 336/200; 336/232

(58) Field of Classification Search
USPC ..... 336/200, 232
See application file for complete search history.

(56) References Cited

U.S. PATENT DOCUMENTS 5,250,923 A * 10/1993 Ushiro et al. ..... 336/83
6,459,351 B1 * 10/2002 Maki et al. ..... 336/200

FOREIGN PATENT DOCUMENTS

JP 04-284612 A 10/1992
JP 07057922 A * 3/1995

(Continued)

OTHER PUBLICATIONS

Notice of Reasons for Refusal issued by the Korean Patent Office, mailed May 29, 2012, in Korean counterpart application No. 10-2011-7001453.

(Continued)

*Primary Examiner* — Tsz Chan
(74) *Attorney, Agent, or Firm* — Law Offices of Katsuhiro Arai

(57) ABSTRACT

Disclosed is a laminated inductor that has good direct current superimposition characteristics, does not cause a variation in temperature characteristics, suppresses the occurrence of delamination, and can be stably manufactured. Also disclosed are a method for manufacturing the laminated inductor and a laminated choke coil. A laminated inductor (10) for use as a choke coil in a power supply circuit includes a rectangular parallelepiped-shaped laminated chip (1) and at least one pair of external electrodes (8) that are provided at the end of the laminated chip (1) and are conductively connected to the end of a coil. The laminated chip (1) includes a plurality of magnetic material layers (3) formed of an Ni—Zn—Cu ferrite, a plurality of conductive layers (2), which are laminated through the magnetic material layers (3) to constitute a coil, and at least one nonmagnetic layer (4) formed of a Ti—Ni—Cu—Mn—Zr—Ag-base dielectric material and formed in contact with a plurality of the magnetic material layers (3).

5 Claims, 4 Drawing Sheets

(56) References Cited

FOREIGN PATENT DOCUMENTS

| | | | |
|---|---|---|---|
| JP | 08-8198 | B2 | 1/1996 |
| JP | 08-124746 | A | 5/1996 |
| JP | 2504725 | B2 | 6/1996 |
| JP | 10-308118 | A | 11/1998 |
| JP | 11-097245 | A | 4/1999 |
| JP | 11-097256 | A | 4/1999 |
| JP | 2977632 | B2 | 11/1999 |
| JP | 2001-044037 | A | 2/2001 |

OTHER PUBLICATIONS

Notification of First Office Action issued by Chinese Patent Office, mailed Jun. 13, 2012, for Chinese counterpart application No. 200980130266.5.

* cited by examiner

LAMINATED INDUCTOR, METHOD FOR MANUFACTURING THE LAMINATED INDUCTOR, AND LAMINATED CHOKE COIL

This application is the U.S. National Phase under 35 U.S.C. §371 of International Application PCT/JP2009/063901, filed Jul. 30, 2009, which claims priority to Japanese Patent Application No. 2008-195575, filed Jul. 30, 2008. The International Application was published under PCT Article 21(2) in a language other than English.

TECHNICAL FIELD

The present invention relates to a laminated inductor, and more particularly to a laminated power choke coil used in DC/DC converters.

BACKGROUND ART

Superimposition characteristics are important product characteristics for power choke coils used in DC/DC converters and other power supply circuit components.

Laminated power choke coils (laminated choke coils) adopt the method to form a nonmagnetic layer in a location where magnetic fluxes are concentrated, by means of simultaneous sintering with a magnetic layer, to suppress magnetic saturation and thereby improve superimposition characteristics.

Patent Literatures 1 and 2 describe examples of the above method, where a nonmagnetic layer is made of, for example, Zn—Cu ferrite whose component elements are close to Ni—Zn—Cu ferrite that constitutes a magnetic layer.

In Patent Literature 3, use as a nonmagnetic layer of a ceramic material selected from $ZnFe_2O_4$, $TiO_2$, $WO_2$, $Ta_2O_5$, cordierite ceramics, BaSnN ceramics and CaMgSiAlB ceramics is described.

However, Patent Literature 3 does not mention using Ni—Zn—Cu ferrite as a magnetic layer, and $ZnFe_2O_4$ (zinc ferrite) is the only specific example of a nonmagnetic layer given and there is no mention of $TiO_2$ in particular. On the other hand, Patent Literature 4 describes "a dielectric ceramic composition produced by blending $TiO_2$ with 0.1 to 10 percent by weight of $ZrO_2$, 1.5 to 6.0 percent by weight of CuO, 0.2 to 20 percent by weight of $Mn_3O_4$, and 2.0 to 15 percent by weight of NiO, to a total percentage by weight of 100," while Patent Literature 5 describes "a dielectric ceramic composition characterized in that it is constituted by CuO (1.0 to 5.0 percent by weight), $Mn_3O_4$ (0.2 to 10 percent by weight), NiO (0.5 to 14 percent by weight), $Ag_2O$ (0.1 to 10 percent by weight), and $TiO_2$ making up the remainder." However, each only indicates that such a composition can be used as a material for capacitors used in combined inductor/capacitor components, and its use for nonmagnetic layers in laminated inductors is not indicated.

As described in Patent Literatures 1 and 2, however, use of a nonmagnetic layer made of Zn—Cu ferrite results in the Zn component of Zn—Cu ferrite diffusing to Ni—Zn—Cu ferrite in the simultaneous sintering process, and the Ni component of Ni—Zn—Cu ferrite diffusing to Zn—Cu ferrite, thereby causing a formation of Ni—Zn—Cu ferrite whose Ni concentration has a slope. These diffusion layers are constituted by Ni—Zn—Cu ferrite whose Curie point differs along the Ni concentration slope, meaning that as the temperature rises, areas of low Ni concentrations change from magnetic to nonmagnetic. This has been a problem because the apparent nonmagnetic layer thickness changes with the temperature, resulting in poor temperature characteristics of the product.

Also, a laminated choke coil has a conductive layer formation region where conductive layers constituting a coil are laminated alternately with magnetic material layers with at least one nonmagnetic layer inserted therebetween, and a yoke region constituted by magnetic material layers that are positioned at the top and bottom in the direction of lamination and serve as a yoke to connect the magnetic fluxes formed on the inner side of the coil and magnetic fluxes formed on the outer side of the coil. Accordingly when a laminated choke coil is sintered, sintering progresses as the sintering of the metal constituting the coil-constituting conductive layers interacts with the sintering of the magnetic material constituting the magnetic material layers, in the conductive layer formation region constituting the coil. In the yoke region, on the other hand, sintering progresses mainly in the magnetic material, and accordingly latent stress tends to generate between the two regions. Therefore, the nonmagnetic layers which are located in the conductive layer formation region constituting the coil and which have low affinity with magnetic material layers and coil conductive layers become thresholds of latent stress relief, and for this reason delamination occurs easily between the nonmagnetic layers and the adjacent magnetic material layers or coil-constituting conductive layers.

In addition to Zn—Cu ferrite, glass materials are generally known as nonmagnetic materials. Since their coefficients of linear expansion are different from those of ferrites, simultaneous sintering of ferrite and glass materials will cause delamination at the bonded interface.

Also a $TiO_2$ material sintered at low temperature is applied as a nonmagnetic material that can be simultaneously sintered with magnetic layers. However, this specification does not allow a sufficient inter-diffusion interface to form and sometimes separation occurs at the interfacial layer.

Patent Literature 1 Japanese Patent Laid-open No. Hei 11-97245

Patent Literature 2 Japanese Patent Laid-open No. 2001-44037

Patent Literature 3 Japanese Patent Laid-open No. Hei 11-97256

Patent Literature 4 Japanese Patent No. 2977632

Patent Literature 5 Examined Japanese Patent Laid-open No. Hei 8-8198

SUMMARY OF THE INVENTION

Problems to be Solved by the Invention

The present invention was invented in light of the aforementioned situation and it is the object of the present invention to provide a laminated inductor that offers favorable DC superimposition characteristics, is free from variation in temperature characteristics, suppresses occurrence of delamination, and can be produced in a stable manner, and a method of manufacturing the same, as well as a laminated choke coil.

Means for Solving the Problems

The present invention adopts the following means to solve the aforementioned problems:

(1) A laminated inductor used as a choke coil in power supply circuits, comprising: a rectangular parallelepiped-shaped laminated chip having a plurality of magnetic material layers constituted by Ni—Zn—Cu ferrite, a plurality of conductive layers that are laminated via the aforementioned magnetic material layers to constitute a coil, and at least one nonmagnetic layer constituted by Ti—Ni—Cu—Mn—Zr—Ag dielectric and formed in a manner contacting a plurality of the aforementioned magnetic material layers; and at least one pair of external electrodes provided at ends of the aforementioned laminated chip and electrically connected to ends of the aforementioned coil.

(2) A laminated inductor according to (1) above, wherein the aforementioned laminated chip has a bonded interface where the Ni—Zn—Cu ferrite of the aforementioned magnetic material layer and Ti—Ni—Cu—Mn—Zr—Ag dielectric of the aforementioned nonmagnetic layer are inter-diffused.

(3) A laminated inductor according to (1) or (2) above, wherein the aforementioned nonmagnetic layer is constituted by a dielectric whose main component is $TiO_2$ and which also contains NiO, CuO, $Mn_3O_4$, $ZrO_2$ and $Ag_2O$ or Ag.

(4) A laminated inductor according to (3) above, wherein the aforementioned dielectric contains $TiO_2$, 2.0 to 15 percent by weight of NiO, 1.5 to 6.0 percent by weight of CuO, 0.2 to 20 percent by weight of $Mn_3O_4$, 0.1 to 10 percent by weight of $ZrO_2$, and 0.01 to 10 percent by weight of $Ag_2O$, based on equivalent oxide, to a total percentage by weight of 100.

(5) A method of manufacturing a laminated inductor, comprising: a step to prepare ferrite powder paste containing $Fe_2O_3$, NiO, ZnO and CuO; a step to prepare dielectric powder paste whose main component is $TiO_2$ and which also contains NiO, CuO, $Mn_3O_4$, $ZrO_2$ and $Ag_2O$ or Ag; a step to form magnetic sheets by coating the aforementioned ferrite powder paste and print conductive paste patterns on these magnetic sheets, and then pressure-bond these layers to form a laminate in a manner allowing the conductive paste patterns of vertically adjacent magnetic sheets to be connected via through holes to form a helical coil, and also in a manner causing at least one nonmagnetic sheet formed by coating the aforementioned dielectric powder paste or nonmagnetic pattern formed by printing the aforementioned nonmagnetic powder paste to be inserted therebetween; and a step to sinter the aforementioned laminate to obtain a laminated chip.

(6) A method of manufacturing a laminated inductor, comprising: a step to prepare ferrite powder paste containing $Fe_2O_3$, NiO, ZnO and CuO; a step to prepare dielectric powder paste whose main component is $TiO_2$ and which also contains NiO, CuO, $Mn_3O_4$, $ZrO_2$ and $Ag_2O$ or Ag; a step to form magnetic sheets by coating the aforementioned ferrite powder paste and print conductive paste patterns on these magnetic sheets, and also print magnetic paste patterns using the aforementioned ferrite powder paste, alternately in such a way that at least one nonmagnetic pattern formed by printing the aforementioned dielectric powder paste is inserted therebetween, to obtain a laminate; and a step to sinter the aforementioned laminate to obtain a laminated chip.

(7) A method of manufacturing a laminated inductor according to (5) or (6) above, wherein the aforementioned step to sinter the aforementioned laminate to obtain a laminated chip is such that Ni—Zn—Cu ferrite constituting the aforementioned magnetic sheet or magnetic material layer formed by the magnetic paste pattern is inter-diffused with Ti—Ni—Cu—Mn—Zr—Ag dielectric constituting the aforementioned nonmagnetic sheet or nonmagnetic layer formed by the nonmagnetic pattern, to form a bonded interface.

(8) A method of manufacturing a laminated inductor according to (5) or (6) above, wherein the aforementioned dielectric powder is constituted by blending $TiO_2$ with 2.0 to 15 percent by weight of NiO, 1.5 to 6.0 percent by weight of CuO, 0.2 to 20 percent by weight of $Mn_3O_4$, 0.1 to 10 percent by weight of $ZrO_2$, and 0.01 to 10 percent by weight of $Ag_2O$, to a total percentage by weight of 100.

(9) A laminated choke coil having a conductive layer formation region where conductive layers constituting a coil are laminated alternately with magnetic material layers with at least one nonmagnetic layer inserted therebetween, and a yoke region constituted by magnetic material layers that are positioned at the top and bottom in the direction of lamination and serve as a yoke to connect the magnetic fluxes formed on the inner side of the coil and magnetic fluxes formed on the outer side of the coil, wherein the aforementioned magnetic material layer is constituted by Ni—Zn—Cu ferrite and the aforementioned nonmagnetic layer, by Ti—Ni—Cu—Mn—Zr—Ag dielectric.

Effects of the Invention

The present invention provides a laminated inductor that offers favorable DC superimposition characteristics, is free from variation in temperature characteristics, suppresses occurrence of delamination, and can be produced in a stable manner, as well as a laminated choke coil.

The aforementioned object and other objects, structural characteristics, and operations and effects of the present invention are made clear by the following explanation and attached drawings.

BRIEF DESCRIPTION OF THE DRAWINGS

FIG. 3(*a*) indicates a laminated inductor according to the example, while FIG. 3(*b*) indicates a laminated inductor according to the comparative example.

BEST MODE FOR CARRYING OUT THE INVENTION

Figure 1:
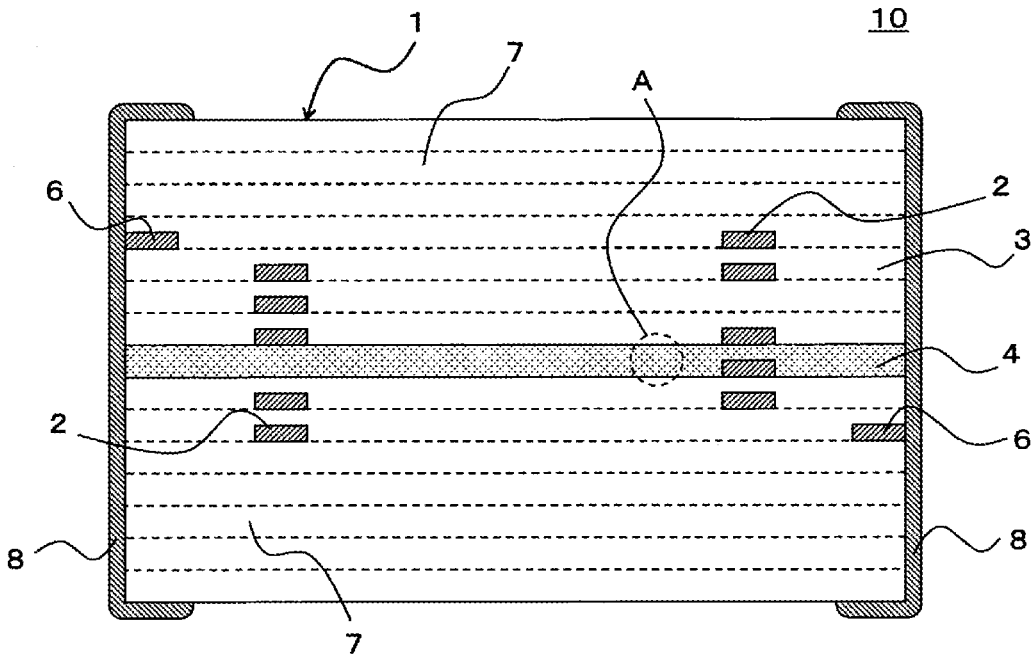
FIG. 1 is a longitudinal section view showing the internal structure of a laminated inductor conforming to the present invention.

A first embodiment of a laminated inductor conforming to the present invention is explained. As shown in FIG. 1, a laminated inductor 10 in the first embodiment has a rectangular parallelepiped-shaped laminated chip 1, and external electrodes 8, 8 made of Ag or other metal and provided on both ends of the laminated chip 1 in the lengthwise direction.

Figure 2:
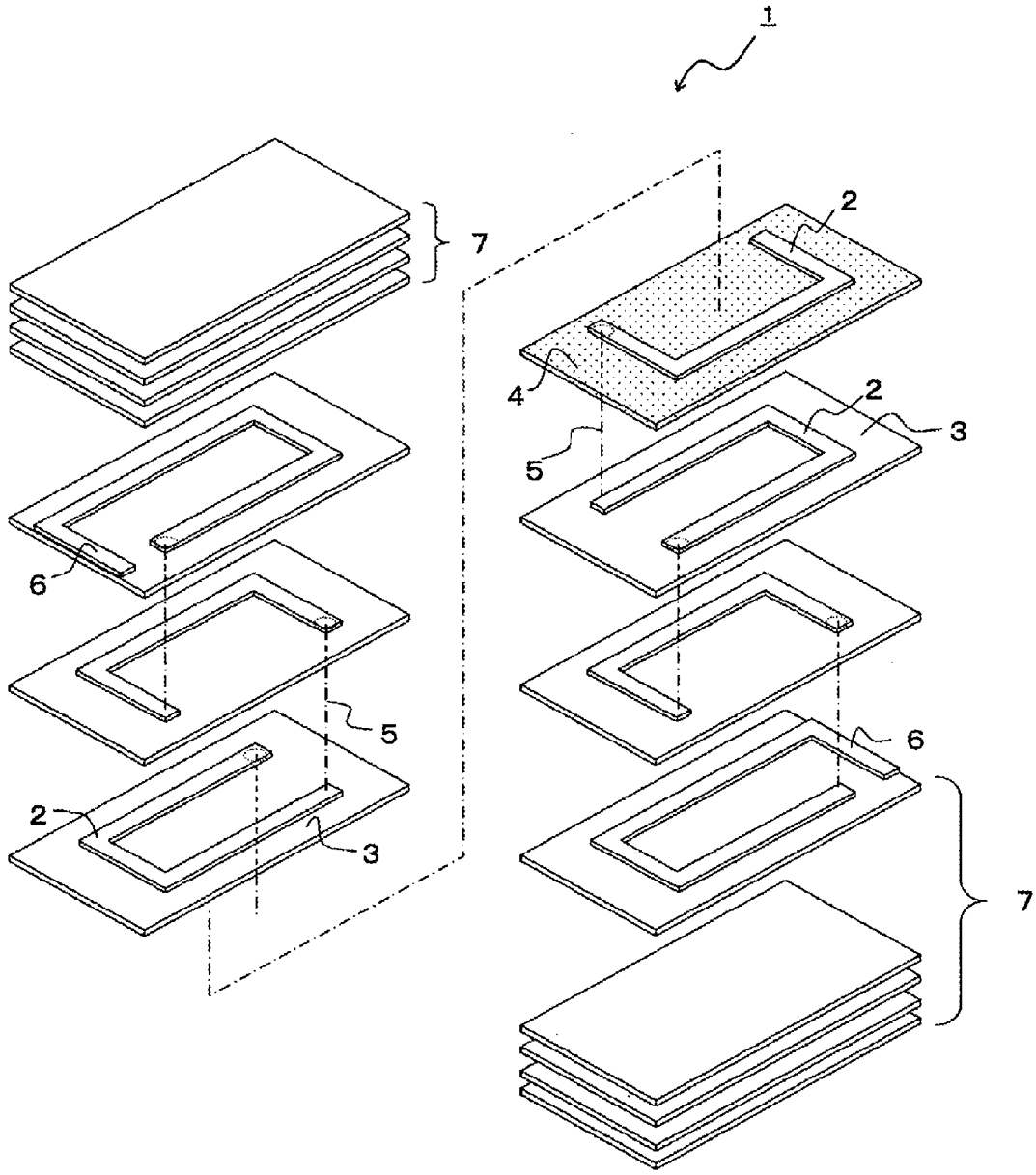
FIG. 2 is an exploded perspective view showing the internal structure of a laminated chip of a laminated inductor conforming to the present invention.

As shown in FIG. 2, the laminated chip 1 has a structure where a plurality of conductive layers constituting a coil 2, 2 are laminated with a magnetic material layer 3 in between, and at the center of the laminated chip 1 in the direction of lamination a nonmagnetic layer 4 is provided in a manner replacing at least one magnetic material layer 3.

Under the present invention, the laminated chip 1 has a plurality of magnetic material layers 3, 3 constituted by Ni—Zn—Cu ferrite, and a nonmagnetic layer 4 constituted by Ti—Ni—Cu—Mn—Zr—Ag dielectric. The aforementioned Ni—Zn—Cu ferrite is a ferrite that contains $Fe_2O_3$, NiO, ZnO and CuO. The nonmagnetic layer 4 constituted by the aforementioned Ti—Ni—Cu—Mn—Zr—Ag dielectric is a dielectric whose main component is $TiO_2$ and which also contains NiO, CuO, $Mn_3O_4$, $ZrO_2$ and $Ag_2O$ (Ag may be used instead of $Ag_2O$), desirably formed by blending $TiO_2$ with 2.0 to 15 percent by weight of NiO, 1.5 to 6.0 percent by weight of CuO, 0.2 to 20 percent by weight of $Mn_3O_4$, 0.1 to 10 percent by weight of $ZrO_2$, and 0.01 to 10 percent by weight of $Ag_2O$, to a total percentage by weight of 100.

By adding CuO and $Mn_3O_4$ as auxiliaries to the nonmagnetic layer 4, a liquid phase of Cu—Mn—Ti—O is produced during sintering by the reaction of these auxiliaries with a part of $TiO_2$, and this liquid phase makes $TiO_2$ finer at low temperature and thereby promotes rapid grain size growth. On the other hand, $ZrO_2$ has a higher melting point than $TiO_2$, CuO and $Mn_3O_4$, so adding Zr to the aforementioned liquid phase of Cu—Mn—Ti—O increases the melting point and viscosity of the liquid phase. As a result, the speed at which $TiO_2$ grains grow due to sintering of the liquid phase is adjusted and a low-temperature sintered $TiO_2$ material can be obtained which is subject to less oxygen deficiency.

Figure 3:
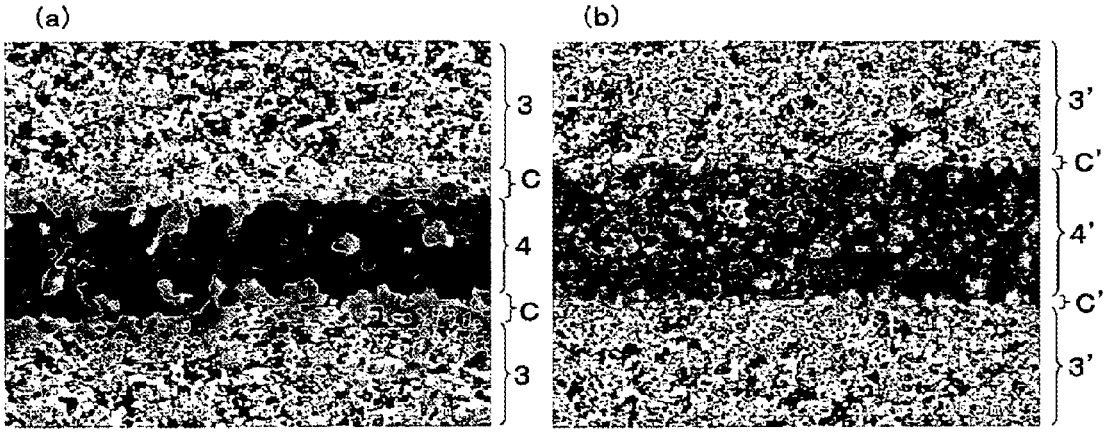
FIG. 3 provides scanning electron microscope (SEM) images of a cross-section of area A indicated by broken lines in FIG. 1 above, showing a laminated interface between a magnetic material layer and a nonmagnetic layer, for laminated inductors produced according to an example conforming to the present invention and a comparative example.

Under the present invention, $Ag_2O$ (or Ag) is added further to the aforementioned low-temperature sintered $TiO_2$ material to constitute the nonmagnetic layer 4 in order to promote the inter-diffusion of material components at the interface and thereby improve the interfacial strength. In other words, the Ni—Zn—Cu ferrite constituting the magnetic material layer 3 and Ti—Ni—Cu—Mn—Zr—Ag dielectric constituting the nonmagnetic layer 4 are inter-diffused as a result of simultaneously sintering to form a bonded interface. As shown in FIG. 3, presence of a nonmagnetic layer to which Ag has been added promotes this inter-diffusion compared to a nonmagnetic layer to which Ag has not been added. It is estimated that $Fe_2TiO_5$ is produced at the bonded interface to form a magnetic gap layer.

Figure 4:
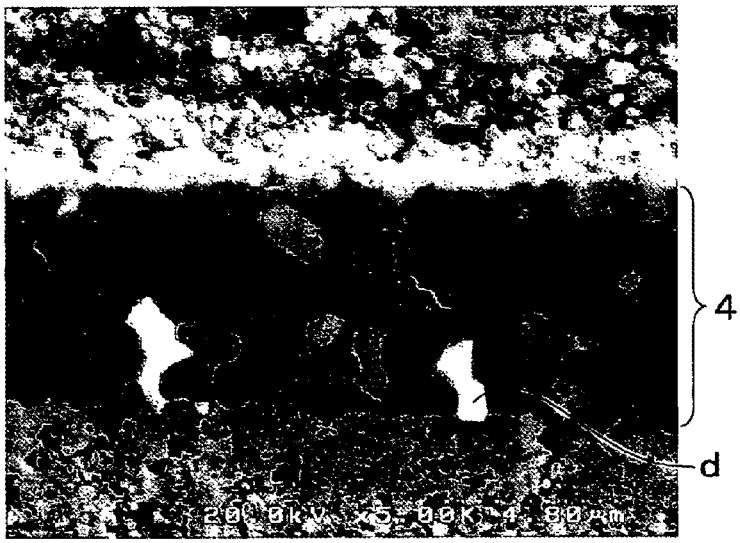
FIG. 4 shows the material structure of a nonmagnetic layer. (In the figure, d shows that Ag has separated and precipitated in the material as a metal.)

Also by adding $Ag_2O$ (or Ag) further to the aforementioned low-temperature sintered $TiO_2$ material to constitute the nonmagnetic layer 4, Ag separates from the material and precipitates in the nonmagnetic layer 4 as a metal component, as shown in FIG. 4, as a result of cooling in the sintering process of the laminated choke coil. This reduces the stress generating between the ferrite constituting the magnetic material layer 3 and low-temperature sintered $TiO_2$ material constituting the nonmagnetic layer 4, thereby preventing delamination and a drop in inductance, while also preventing deterioration of characteristics of the low-temperature sintered $TiO_2$ material whose main component is $TiO_2$.

The main component $TiO_2$ should preferably account for at least 50 percent by weight, but more preferably 70 to 98 percent by weight.

The content of $Ag_2O$ should preferably be in a range of 0.01 to 10 percent by weight because if the content is less than 0.01 percent by weight, delamination and a drop in inductance cannot be suppressed effectively, while a content exceeding 10 percent by weight causes the effects of preventing delamination/drop in inductance to saturate and a network structure where Ag grains are inter-connected is formed to cause the characteristics of the insulator to drop suddenly.

Provided above each magnetic material layer 3 is a C-shaped conductive layer 2 made of Ag or other metal material to constitute a coil. Also in each magnetic material layer 3, through holes 5, 5 are formed in such a way as to overlap with the ends of conductive layers 2, 2 constituting the coil, in order to connect the upper and lower conductive layers 2, 2 through the corresponding magnetic material layers 3, 3. Here, the through holes 5, 5 are holes pre-formed in the magnetic material layer which are filled with the same material as the conductive layer constituting the hole.

The magnetic material layers at the top and bottom provide yoke regions 7, 7, serving as yokes to connect the magnetic fluxes formed on the inner side of the coil and magnetic fluxes formed on the outer side of the coil, while also ensuring sufficient margins at the top and bottom, and therefore these magnetic material layers have no conductive layers constituting the coil or through holes.

Provided above the nonmagnetic layer 4 is a C-shaped conductive layer 2 made of Ag or other metal material to constitute a coil. Also in the nonmagnetic layer 4, a through hole 5 is formed in such a way as to overlap with the ends of conductive layers 2, 2 constituting the coil, in order to connect the upper and lower conductive layers 2, 2 through the nonmagnetic layer 4.

The conductive layers 2, 2, . . . constituting the coil are connected via through holes 5, 5, . . . to constitute a helical coil. The top conductive layer 2 and bottom conductive layer 2 of the coil have drawer parts 6, 6, respectively, where one of these drawer parts 6, 6 is connected to one of the external electrodes 8, 8, while the another of the drawer parts 6, 6 is connected to the another of the external electrodes 8, 8.

Next, a first embodiment of a method of manufacturing laminated inductor conforming to the present invention is explained.

First, when manufacturing a laminated inductor, a magnetic sheet (ferrite sheet) is produced to constitute a Ni—Zn—Cu ferrite magnetic material layer 3 of high magnetic permeability. To be specific, fine ferrite powder is produced by pre-baking and crushing a material mixture mainly constituted by $Fe_2O_3$, NiO, CuO and ZnO, and then ethanol or other solvent and PVA or other binder are added and mixed to obtain ferrite powder paste, after which this ferrite powder paste is coated flat on a film of PET, etc., using the doctor blade or other method, to obtain a magnetic sheet (ferrite sheet).

Also, a nonmagnetic sheet (dielectric sheet) or nonmagnetic pattern is produced to constitute a Ti—Ni—Cu—Mn—Zr—Ag dielectric nonmagnetic layer (4). To be specific, dielectric powder whose main component is $TiO_2$ and which also contains NiO, CuO, $Mn_3O_4$, $ZrO_2$ and $Ag_2O$ (or Ag) is mixed with a solvent and binder to obtain dielectric powder paste, in the same manner as above, and this dielectric powder paste is coated flat on a film of PET, etc., using the doctor blade, slurry build or other method to obtain a nonmagnetic sheet (dielectric sheet) or nonmagnetic pattern by printing the paste in a pattern.

Next, holes to form through holes 5 are stamped using dies, pierced by laser cutting, or otherwise formed in the magnetic sheet and nonmagnetic sheet according to a specified layout. Then, conductive paste for forming a conductive layer 2 constituting a coil is printed, according to a specified pattern, on the magnetic sheet and nonmagnetic sheet on which holes to form through holes have been formed, by means of screen printing, etc. For this conductive paste, metal paste whose main component is Ag can be used, for example.

Next, the magnetic and nonmagnetic sheets on which conductive paste has been printed are pressure-bonded in such a way that the conductive paste patterns 2 of the upper and lower sheets are connected via through holes 5 to constitute a helical coil, to obtain a laminate. Here, the magnetic sheet 3 and nonmagnetic sheet 4 are laminated in the order shown in FIG. 2 to obtain a layered structure.

Next, this laminate is cut to unit dimensions to obtain a chip-shaped laminate. This chip-shaped laminate is then heated to approx. 400 to 500° C. for 1 to 3 hours in air to remove the binder component, and then the obtained chip-shaped laminate free from binder component is sintered at 850 to 920° C. for 1 to 3 hours in air.

To form external electrodes, conductive paste is applied at both ends of the sintered laminated chip by the dip method, etc. For this conductive paste, metal paste whose main component is Ag can be used, for example, as above. The laminated chip on which conductive paste has been applied is sintered at approx. 500 to 800° C. for 0.2 to 2 hours in air to form external electrodes. Finally, each external electrode is plated with Ni, Sn, etc., to obtain a laminated inductor 10.

Next, a second embodiment of a method of manufacturing laminated inductor conforming to the present invention is explained. (No illustration is provided.)

First, when manufacturing a laminated inductor, a magnetic sheet (ferrite sheet) is produced to constitute a Ni—Zn—Cu ferrite magnetic material layer of high magnetic permeability. To be specific, fine ferrite powder is produced by pre-baking and crushing a material mixture mainly constituted by $Fe_2O_3$, NiO, CuO and ZnO, and then ethanol or other solvent and PVA or other binder are added and mixed to obtain ferrite powder paste, after which this ferrite powder paste is coated flat on a film of PET, etc., using the doctor blade or other method, to obtain a magnetic sheet (ferrite sheet).

Next, conductive paste for forming a conductive layer to constitute a coil is printed in a certain pattern on the aforementioned magnetic sheet by means of screen printing, etc. For this conductive paste, metal paste whose main component is Ag can be used, for example.

Then, a magnetic pattern (ferrite pattern) is produced to constitute a Ni—Zn—Cu ferrite magnetic material layer of high magnetic permeability. To be specific, fine ferrite powder is produced by pre-baking and crushing a material mixture mainly constituted by $Fe_2O_3$, NiO, CuO and ZnO, and then ethanol or other solvent and PVA or other binder are added and mixed to obtain magnetic paste (ferrite powder paste), after which this ferrite powder paste is printed on the conductive pattern formed above in a manner keeping one end of the pattern to remain exposed, to obtain a magnetic pattern (ferrite pattern).

In the same manner as explained above, conductive paste for forming a conductive layer to constitute a coil is printed in a certain pattern on the aforementioned magnetic pattern by means of screen printing, etc., so as to connect to one end of the aforementioned conductive paste pattern previously formed.

In the same manner as explained above, the magnetic pattern and conductive paste pattern are printed alternately by means of screen printing, etc.

Next, a nonmagnetic pattern (dielectric pattern) is produced to constitute a Ti—Ni—Cu—Mn—Zr—Ag dielectric nonmagnetic layer. To be specific, dielectric powder whose main component is $TiO_2$ and which also contains NiO, CuO, $Mn_3O_4$, $ZrO_2$ and $Ag_2O$ (or Ag) is mixed with a solvent and binder to obtain dielectric powder paste, in the same manner as above, and this dielectric powder paste is printed on the laminate obtained above, to obtain a nonmagnetic pattern.

In the same manner as explained above, the magnetic pattern and conductive paste pattern are printed alternately by means of screen printing, etc.

Next, the obtained laminate is cut to unit dimensions to obtain a chip-shaped laminate. This laminate is then heated to approx. 400 to 500° C. for 1 to 3 hours in air to remove the binder component, and then the obtained chip-shaped laminate free from binder component is sintered at 850 to 920° C. for 1 to 3 hours in air.

To form external electrodes, conductive paste is applied at both ends of the sintered laminated chip by the dip method, etc. For this conductive paste, metal paste whose main component is Ag can be used, for example, as above. The laminated chip on which conductive paste has been applied is sintered at approx. 500 to 800° C. for 0.2 to 2 hours in air to form external electrodes. Finally, each external electrode is plated with Ni, Sn, etc., to obtain a laminated inductor.

When manufacturing a laminated choke coil, coil conductors and Ni—Zn—Cu ferrite magnetic material layers are laminated alternately with at least one nonmagnetic layer constituted by Ti—Ni—Cu—Mn—Zr—Ag dielectric inserted therebetween, to form a conductive layer formation region for constituting a coil, after which yoke regions 7, 7 constituted by a magnetic material layer are provided at the top and bottom in the direction of lamination in such way as to connect the magnetic fluxes formed on the inner side of the coil and magnetic fluxes formed on the outer side of the coil, and then the whole assembly is sintered under conditions similar to those explained above. In the sintering process, sintering progresses as the sintering of the metal constituting the coil-constituting conductive layers interacts with the sintering of the magnetic material constituting the magnetic material layers, in the conductive layer formation region constituting the coil. In the yoke regions 7, 7, on the other hand, sintering progresses mainly in the magnetic material, and accordingly latent stress tends to generate between the two regions. Under the present invention, however, the nonmagnetic layer is constituted by a low-temperature sintered $TiO_2$ material to which Ag has been added (dielectric powder whose main component is $TiO_2$ and which also contains NiO, CuO, $Mn_3O_4$, $ZrO_2$ and $Ag_2O$), and this reduces the stress generating in the magnetic material layer and nonmagnetic layer to prevent delamination.

EXAMPLE

The present invention is explained in greater detail below using an example.

Ethanol (solvent) and PVA binder were added to and mixed with Ni—Zn—Cu ferrite powder of the composition shown in Table 1 to prepare ferrite powder paste, and this paste was applied on a PET film to obtain a magnetic sheet (magnetic material layer) 3. Solvent and binder were also added to and mixed with powder of a dielectric (low-temperature sintered $TiO_2$ material to which Ag has been added) whose main component is $TiO_2$ and which also contains NiO, CuO, $Mn_3O_4$, $ZrO_2$ and $Ag_2O$, as shown in Table 1, to prepare dielectric powder paste in the same manner, and this paste was applied on a PET film to obtain a nonmagnetic sheet (nonmagnetic layer) 4.

On each green sheet obtained, conductive paste pattern (a C-shaped conductive layer constituting a coil) 2 was printed and then the sheets were laminated to produce a laminate, after which the obtained laminate was cut to unit dimensions to obtain a chip-shaped laminate. The obtained chip-shaped laminate was heated to 500° C. for 1 hour to remove the binder component, followed by 1 hour of sintering at 900° C. Ag external electrodes 8, 8 were attached on both ends of the laminated chip 1 obtained above, whose structure is shown in the exploded perspective view in FIG. 2, and then Ni/Sn plating was performed to obtain a laminated inductor 10 of the example.

COMPARATIVE EXAMPLE

Ethanol (solvent) and PVA binder were added to and mixed with Ni—Zn—Cu ferrite powder of the composition shown in Table 1 and the obtained paste was applied on a PET film to obtain a magnetic sheet (magnetic material layer). Solvent and binder were also added to and mixed with powder of a dielectric (low-temperature sintered $TiO_2$ material to which Ag has not been added) whose main component is $TiO_2$ and which also contains NiO, CuO, $Mn_3O_4$ and $ZrO_2$, as shown in Table 1, to prepare dielectric powder paste in the same manner, and this paste was applied on a PET film to obtain a nonmagnetic sheet (nonmagnetic layer).

On each green sheet obtained, conductive paste pattern (a C-shaped conductive layer constituting a coil) was printed and then the sheets were laminated to produce a laminate, after which the obtained laminate was cut to unit dimensions to obtain a chip-shaped laminate. The obtained chip-shaped laminate was heated to 500° C. for 1 hour to remove the binder component, followed by 1 hour of sintering at 900° C. Ag external electrodes 8, 8 were attached on both ends of the laminated chip obtained above, and then Ni/Sn plating was performed to obtain a laminated inductor of the comparative example.

TABLE 1

| Material Composition (wt %) | | | |
|---|---|---|---|
| | | Low-temperature sintered $TiO_2$ material | |
| | Ni—Zn ferrite | Ag not added | Ag added |
| Fe203 | 66.3 | — | — |
| NiO | 14.8 | 6.3 | 6.3 |
| ZnO | 12.5 | — | — |
| CuO | 6.4 | 2.7 | 2.7 |
| ZrO2 | — | 0.2 | 0.2 |
| TiO2 | — | 90.3 | 90.3 |
| Mn3O4 | — | 0.5 | 0.5 |
| Ag2O | — | — | 0.25 |

(Interface Formation)

FIG. 3 provides scanning electron microscope (SEM) images showing the cross-section of the laminated interface between the magnetic material layer and nonmagnetic layer, for laminated inductors produced above according to the Example and Comparative Example. FIG. 3(*a*) indicates a laminated inductor 10 according to the example, where magnetic material layers 3, 3 constituted by Ni—Zn—Cu ferrite are inter-diffused with a nonmagnetic layer 4 constituted by a low-temperature sintered $TiO_2$ material to which Ag has been added, to form a bonded interface that bonds the layers. FIG. 3(*b*) indicates a laminated inductor according to the comparative example, where magnetic material layers 3', 3' constituted by Ni—Zn—Cu ferrite are inter-diffused with a nonmagnetic layer 4' constituted by a low-temperature sintered $TiO_2$ material to which Ag has not been added, to form a bonded interface that bonds the layers. As shown in FIG. 3(*b*), the laminated inductor of the comparative example to which Ag has not been added has an inter-diffusion distance (thickness of inter-diffusion layer C') of 1.1 μm, while the laminated inductor of the example to which Ag has been added has an inter-diffusion distance (thickness of inter-diffusion layer C) of 3.2 μm, as shown in FIG. 3(*a*). This suggests that adding Ag to the low-temperature sintered $TiO_2$ material promotes inter-diffusion.

(Material Composition)

FIG. 4 shows the material composition of the nonmagnetic layer in the laminated inductor of the example, observed in the same manner as above. As shown by d in this figure, Ag separated and precipitated in the nonmagnetic layer material. During sintering, Ag dissolves in the liquid phase as an auxiliary that promotes diffusion. However, it precipitates in the cooling stage and therefore presents no negative effects such as lowering the chemical resistance of the material.

(Inductance)

Table 2 shows the inductances of obtained laminated inductors. Table 2 indicates that the inductance increases as more Ag is added to the low-temperature sintered $TiO_2$ material constituting the nonmagnetic layer.

TABLE 2

| Amount of Ag added (wt %) | Inductance (μH) |
|---|---|
| 0 | 1.02 |
| 0.01 | 1.03 |
| 0.1 | 1.05 |
| 1 | 1.12 |
| 5 | 1.21 |

(Temperature Characteristics)

Figure 5:
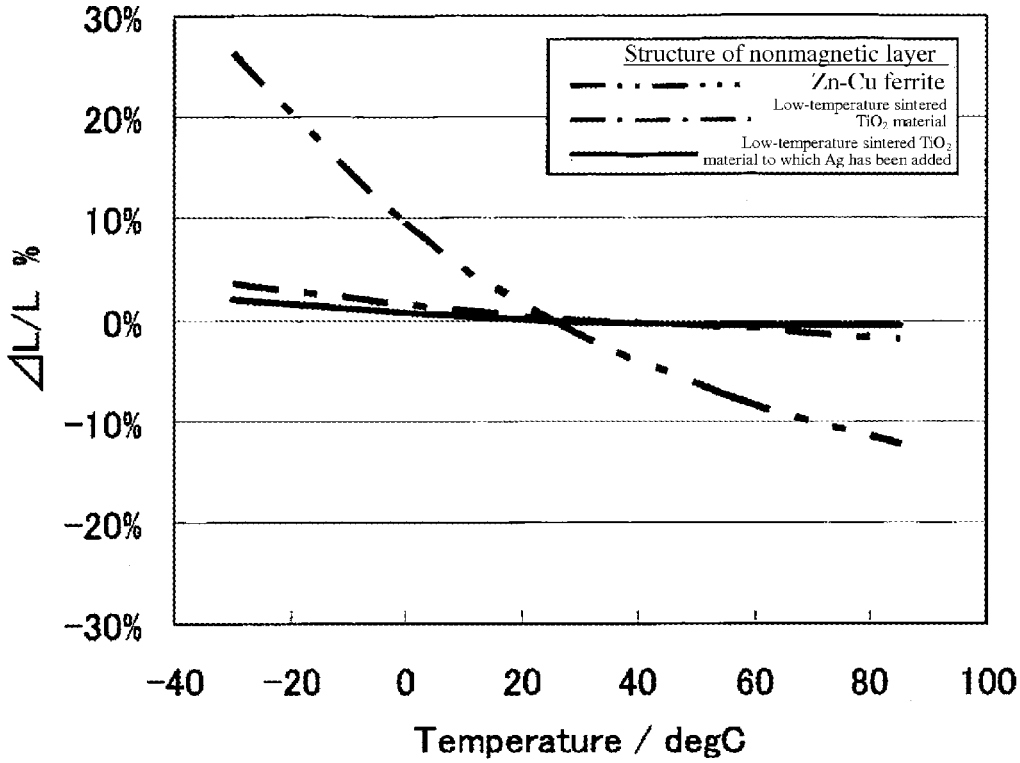
FIG. 5 is a graph showing how the inductances of laminated inductors according to the example and comparative example change according to the temperature characteristics.

Inductance changes due to temperature characteristics were measured on the obtained laminated inductors. The results are shown in FIG. 5, together with the characteristics of a laminated inductor using Zn—Cu ferrite for the nonmagnetic layer. The laminated inductor using a low-temperature sintered $TiO_2$ material for the nonmagnetic layer presents a low rate of change in inductance due to temperature which is less than one-tenth the rate of change of the laminated inductor using Zn—Cu ferrite for the nonmagnetic layer. The laminated inductor obtained by the example of the present invention, which uses for the nonmagnetic layer a low-temperature sintered $TiO_2$ material to which Ag has been added, shows less variation in temperature characteristics.

(Delamination)

All 100 laminated inductors obtained were ground to their center and the interface of Ni—Zn—Cu ferrite and low-temperature sintered $TiO_2$ material was observed with a SEM to check for delamination. For the purpose of comparison, laminated inductors using $TiO_2$ for the nonmagnetic layer were also checked for delamination in the same manner. The results are shown in Table 3. Laminated inductors using a low-temperature sintered $TiO_2$ material for the nonmagnetic layer showed a markedly lower delamination ratio compared to laminated inductors using only $TiO_2$ for the nonmagnetic layer. In particular, delamination was not found in Ag-added laminated inductors obtained by the example of the present invention.

TABLE 3

| | $TiO_2$ | Low-temperature sintered $TiO_2$ material | Low-temperature sintered $TiO_2$ material to which Ag has been added |
|---|---|---|---|
| Delamination ratio | 100% | 5% | 0% |

(Elution Amounts)

Table 4 shows a composition for promoting inter-diffusion. This composition shown in Table 4 was used for the nonmagnetic layer to produce a chip-shaped laminate according to the aforementioned example, after which the laminate was sintered at 900° C. for 1 hour to obtain a 3-mm square sample (veneer) showing similar formation of an inter-diffusion layer. This veneer was soaked in plating solution used in mass production, to measure the elution amounts of material components. A sample that used for the nonmagnetic layer a low-temperature sintered $TiO_2$ material to which Ag had been added presented no elution of its material components because the chemical resistance of the material did not drop.

TABLE 4

Material Composition (wt %) and Elution Amounts after Soak in Plating Solution

| | Ag added | Li added | Zn added |
|---|---|---|---|
| TiO2 | 90.3 | 90.3 | 90.3 |
| NiO | 6.3 | 6.3 | 6.3 |
| CuO | 2.7 | 2.7 | 2.7 |
| Mn3O4 | 0.5 | 0.5 | 0.5 |
| ZrO2 | 0.2 | 0.2 | 0.2 |
| Ag2O | 0.25 | — | — |
| Li2O | — | 0.57 | — |
| ZnO | — | — | 1.15 |
| Elution amount (ppm) | 0 | 128 | 38 |

As shown above, laminated conductors conforming to the present invention were confirmed to offer favorable DC superimposition characteristics, be free from variation in temperature characteristics, and suppress occurrence of delamination.

| Description of the Symbols | |
|---|---|
| 1 | Laminated chip |
| 2 | Coil-constituting conductive layer (conductive paste pattern) |
| 3 | Magnetic material layer (magnetic sheet) |
| 4 | Nonmagnetic layer (nonmagnetic sheet) |
| 5 | Through hole |
| 6 | Drawer part |
| 7 | Yoke region |
| 8 | External electrode |
| 10 | Laminated inductor |
| C | Inter-diffusion layer |
| d | Ag-precipitated area |

The invention claimed is:

1. A laminated inductor used as a choke coil in power supply circuits, comprising:

a rectangular parallelepiped-shaped laminated chip having:

a plurality of magnetic material layers constituted by Ni—Zn—Cu ferrite, a plurality of conductive layers that are laminated via the magnetic material layers to constitute a coil, and at least one nonmagnetic layer constituted by Ti—Ni—Cu—Mn—Zr—Ag dielectric and formed in a manner contacting a plurality of the magnetic material layers, the nonmagnetic layer being constituted by a dielectric whose main component is $TiO_2$ and which also contains NiO, CuO, $Mn_3O_4$, $ZrO_2$ and $Ag_2O$ or Ag, wherein the laminated chip has an inter-diffusion layer at a bonded interface where the Ni—Zn—Cu ferrite of the magnetic material layer and the Ti—Ni—Cu—Mn—Zr—Ag dielectric of the nonmagnetic layer are inter-diffused; and at least one pair of external electrodes provided at ends of the laminated chip and electrically connected to ends of the coil.

2. A laminated inductor according to claim 1, wherein the dielectric contains $TiO_2$, 2.0 to 15 percent by weight of NiO, 1.5 to 6.0 percent by weight of CuO, 0.2 to 20 percent by weight of $Mn_3O_4$, 0.1 to 10 percent by weight of $ZrO_2$, and 0.01 to 10 percent by weight of $Ag_2O$, based on equivalent oxide, to a total percentage by weight of 100.

3. A laminated inductor according to claim 1, wherein the Ni—Zn—Cu ferrite is constituted solely by $Fe_2O_3$, NiO, ZnO and CuO, and the Ti—Ni—Cu—Mn—Zr—Ag dielectric is constituted solely by $TiO_2$, NiO, CuO, $Mn_3O_4$, $ZrO_2$ and $Ag_2O$ or Ag.

4. A laminated choke coil, comprising:

a coil conductor formation region where conductive layers constituting a coil are laminated alternately with magnetic material layers with at least one nonmagnetic layer inserted therebetween, and a yoke region constituted by magnetic material layers that are positioned at the top and bottom in the direction of lamination and serve as a yoke to connect magnetic fluxes formed on an inner side of the coil and magnetic fluxes formed on an outer side of the coil, wherein the magnetic material layer is constituted by Ni—Zn—Cu ferrite and the nonmagnetic layer is constituted by Ti—Ni—Cu—Mn—Zr—Ag dielectric whose main component is $TiO_2$ and which also contains NiO, CuO, $Mn_3O_4$, $ZrO_2$ and $Ag_2O$ or Ag, and wherein the laminated chip has an inter-diffusion layer at a bonded interface where the Ni—Zn—Cu ferrite of the magnetic material layer and the Ti—Ni—Cu—Mn—Zr—Ag dielectric of the nonmagnetic layer are inter-diffused.

5. A laminated inductor according to claim 4, wherein the Ni—Zn—Cu ferrite is constituted solely by $Fe_2O_3$, NiO, ZnO and CuO, and the Ti—Ni—Cu—Mn—Zr—Ag dielectric is constituted solely by $TiO_2$, NiO, CuO, $Mn_3O_4$, $ZrO_2$ and $Ag_2O$ or Ag.

* * * * *